US005993496A

United States Patent [19]

Sung et al.

[11] Patent Number: 5,993,496

[45] Date of Patent: Nov. 30, 1999

[54] EMULSIFIED FUEL

[76] Inventors: Ju Heung Sung, #386 Yongok-Ri, Chinchon-Eup Chinchon-Kun, Chunchong-Bukdo; Kong Seok Lee, #237-4, Kanseok-4-Dong, Namdong-Ku, Inchon, both of Rep. of Korea

[21] Appl. No.: 09/086,433

[22] Filed: May 28, 1998

[51] Int. Cl.[6] ..... C10L 1/32

[52] U.S. Cl. ..... 44/301; 44/302

[58] Field of Search ..... 44/301

[56] References Cited

U.S. PATENT DOCUMENTS

| | | | |
|---|---|---|---|
| 4,162,143 | 7/1979 | Yount, III | 44/301 |
| 4,347,061 | 8/1982 | Madsen et al. | 44/301 |
| 5,411,558 | 5/1995 | Taniguchi et al. | 44/301 |
| 5,437,693 | 8/1995 | Iizuka et al. | 44/302 |
| 5,584,894 | 12/1996 | Peter-Hoblyn et al. | 44/301 |

*Primary Examiner*—Ellen M. McAvoy
*Attorney, Agent, or Firm*—Michael N. Meller

[57] ABSTRACT

An emulsified combustible fuel is prepared by mixing the fuel with 10 to 50 wt. % of a water mixture containing 0.01 to 1.0 parts by weight of an anionic surfactant, 0.01 to 0.5 parts by weight of polyethylene oxide and 0.001 to 0.2 parts by weight of mathothyl per 100 parts by weight of water. The emulsified fuel can reduce the amount of discharged pollutants by optimizing combustion, thereby saving energy due to high efficiency. Further, it can be used in small, medium or large boiler systems without any control means to constantly maintain the optimal ratio of combustible fuel to water.

2 Claims, No Drawings

EMULSIFIED FUEL

FIELD OF THE INVENTION

The present invention relates to an emulsified fuel. More particularly, it relates to an emulsified fuel, which is characterized in that it is achieved by mixing combustible fuel with water containing special components to optimize the combustion of the fuel.

PRIOR ART

Up to now, the fuel used in domestic industries has mostly been bunker oil or fossil oil. However, when the said fuels burn, pollutants such as $NO_x$, $SO_x$, CO or dust are discharged thereby polluting the environment.

Thus, the government has encouraged the use of high quality fuels such as gas, kerosene or gasoline to reduce air pollution and has even gone so far as to stipulate the use of high quality fuel by law. Further, attempts to develop an alternative fuel or device as well as to research various methods to reduce the air pollution are in full swing.

However, the disadvantage of such high quality fuels is that they are expensive and do not sufficiently reduce the amount of pollutant discharged. Further, high quality fuels do not significantly contribute to energy saving.

Recently, an emulsified fuel mixing combustible fuel with water has been studied as a countermeasure to air pollution and has been proven to considerably contribute to energy saving and the prevention of pollution.

The emulsified fuel has the following advantages during combustion. There are two kinds of emulsified fuel which are achieved by mixing combustible fuel with water; one is the water-in-oil type containing minute water drops in oil and the other is the oil-in-water type containing minute oil drops in water. The water-in-oil type is generally used as an emulsified fuel for combustion. The water-in-oil emulsified fuel increases the surface of the oil by breaking oil into extremely small particles with vapor during combustion and therefore can completely burn out due to the increased contact surface between oil and air.

However, to obtain the said effect, the emulsified fuel must be maintained in a stable condition with the optimal ratio of combustible fuel to water. Particularly, in the event that the combustion load of a boiler is fluctuating, equipment is necessary to control the mixing ratio of fuel to water at an optimal level.

SUMMARY OF THE INVENTION

It is the object of the present invention to provide such emulsified fuel which can reduce the amount of pollutant, such as nitrogen oxide, discharged by optimizing the combustion of fuel, thereby saving energy due to the high efficiency of combustion and which can be used in small, middle or large boilers without special equipment to maintain a constant mixing ratio of combustible fuel to water.

The present invention relates to an emulsified fuel, which is characterized in that it is achieved by mixing combustible fuel with the 10 to 50 wt. % of mixture consisting of 0.01 to 1.0 parts by weight of anionic surfactant, 0.01 to 0.5 parts by weight of polyethylene oxide and 0.001 to 0.2 parts by weight of mathothyl per 100 parts by weight of water.

DETAILED DESCRIPTION OF THE INVENTION

The emulsified fuel according to the present invention, which is characterized in that it is achieved by mixing combustible fuel with the 10 to 50 wt. % of mixture consisting of 0.01 to 1.0 parts by weight of anionic surfactant, 0.01 to 0.5 parts by weight of polyethylene oxide and 0.001 to 0.2 parts by weight of mathothyl per 100 parts by weight of water, reduces the amount of pollutant discharged by optimizing fuel during combustion, saves energy due to high efficiency of combustion, and can be easily used in small, middle or large boilers without special equipment to maintain a constant mixing ratio of combustible fuel to water.

It has been proven through many experiments that water results in optimal combustion and the amount of nitrogen oxides and dust during combustion is dramatically reduced thereby.

Water in the emulsified fuel has the following functions:

When water is added to the fuel, for example kerosene, gasoline, bunker oil or waste oil, one of the two liquids disperses into the other liquid, and emulsion occurs thereby.

Since the appropriately mixed emulsion is formed in a stable condition, the separation between water and oil before combustion is not an issue. Further, since water evaporates at 100° C. and oil evaporates at 300° C., the vapor plays the role of breaking the oil into extremely small particles and increasing the oil surface thereby raising the oxidation rate of oil and oxygen. Consequently, the combustion is optimized.

Further, the said emulsified fuel reduces the discharge of nitrogen oxides, the major cause of air pollution, by optimizing combustion. That is to say, the less oxygen is concentrated during combustion and the shorter the combusted gas stays at a high temperature, the less nitrogen oxides are discharged during combustion. In this regard, since moisture in the forms of particles is homogeneously contained in the emulsified fuel, the said fuel limits the generation of high temperatures in local areas in the flame and further, 20 to 30 volume % of moisture lowers the combustion temperature by evaporating latent heat. Therefore, the emulsified fuel limits the generation of nitrogen oxides by preventing high temperatures in local areas.

The anionic surfactant present in the water plays the role of an emulsifying additive to enhance dispersion and permeation of the chemicals which are added together with water. 0.01 to 1.0 parts by weight of anionic surfactant may be used for obtaining such effect. Specific examples of anionic surfactant may be chosen from alkylnaphthalene sulfonate, di-alkyl sulfosuccinate, alkylbenzene sulfonate, alkylsulfoacetate, α-olefin sulfonate, sodium N-acylmethyl taurate, alkylether phosphate, alkyl phosphate, acylpeptide, alkylether carboxylate, N-acylaminoaxid, fatty alcohol sulfate, alkylether sulfate or polyoxyethylene alkylphenyl ether sulfate. Cationic surfactant as well as anionic surfactant maybe used.

Polyethylene oxide contained in water plays the role of a soluble resin to enhance combustibility and dispersion of sludgy. 0.01 to 0.5 parts by weight of polyethylene oxide may be used for obtaining such effect. It has a general formula, $OH\ (CH_2CH_2O)_nCH_2CH_2OH$, wherein n is more than 300, preferably 300 to 800, more preferably 400 to 600.

Mathothyl is methyl cellulose ether which is formed by reacting caustic soda, methyl-chloride and propylene oxide with cellulose. A mixture of water containing mathothyl lowers the viscosity of the emulsified fuel. Since the viscosity is lowered, the emulsified fuel is easily ejected onto the burner during combustion, and the combustibility is enhanced thereby.

As a result, because the emulsified fuel according to the present invention is mixed with water containing anionic surfactant, polyethylene oxide and mathothyl, the fuel is stabilized without controlling the mixing ratio of fuel and water, and the combustion is thereby optimized.

The present invention will be described in more detail referring to the following examples.

EXAMPLE 1

5 g alkylnaphthalene sulfonate as an anionic surfactant, 1 l water, 2.5 g polyethylene oxide($OH(CH_2CH_2O)_nCH_2CH_2OH$,, n=500) and 0.8 g mathothyl were mixed and maintained at a temperature above 0° C. for 5 hours. Then, the 23 wt. % of resultant mixture was mixed with kerosene to prepare the emulsified fuel according to the present invention.

The emulsified fuel obtained was combusted at a temperature as shown in Table 1. The components of the gas discharged during combustion were measured by BACHARACH MODEL CA300NSX. The concentrations of $O_2$, $CO_2$, nitrogen oxides(NO, $NO_2$ and $NO_x$) and CO were measured. The results are shown in Table 1.

EXAMPLE 2

The method of Example 1 and the temperature of Table 1 were followed, except that alkylbenzenesulfonate was used as a surfactant to prepare the emulsified fuel. The components of the gas discharged during combustion were measured by BACHARACH MODEL CA300NSX. The results are shown in Table 1.

EXAMPLE 3

The method of Example 1 and the temperature of Table 1 were followed, except that the value of n in polyethylene oxide ($OH(CH_2CH_2O)_nCH_2CH_2OH$) was 600. The components of the gas discharged during combustion were measured by BACHARACH MODEL CA300NSX. The results are shown in Table 1.

EXAMPLES 4 TO 6

The emulsified fuel, which was prepared by mixing the mixture from the method of Example 1 with kerosene at a ratio of 20 wt. %, 25 wt. % and 30 wt. % respectively, was combusted at a temperature as shown in Table 1. The components of the gas discharged during combustion were measured by BACHARACH MODEL CA300NSX. The results are shown in Table 1.

COMPARATIVE EXAMPLES 1 TO 6

Conventional kerosene was combusted at a temperature as illustrated in Table 1. The components of the gas discharged during combustion were measured by BACHARACH MODEL CA300NSX. The results are shown in Table 1.

TABLE 1

| | Kind of fuels | Combustion Temp. (° C.) | $O_2$ (%) | $CO_2$ (%) | PCO | pNO | $PNO_2$ | PNOx |
|---|---|---|---|---|---|---|---|---|
| Ex. 1 | Emulsified fuel | 478.2 | 7.4 | 7.6 | 53 | 50 | 1 | 50 |
| Ex. 2 | Emulsified fuel | 465.6 | 5.7 | 8.5 | 7 | 62 | 0 | 62 |
| Ex. 3 | Emulsified fuel | 474.7 | 3.8 | 9.6 | 20 | 56 | 0 | 56 |
| Ex. 4 | Emulsified fuel | 474.1 | 2.8 | 10.2 | 11 | 68 | 0 | 68 |
| Ex. 5 | Emulsified fuel | 457.1 | 5.0 | 8.9 | 5 | 63 | 0 | 63 |
| Ex. 6 | Emulsified fuel | 455.2 | 3.5 | 9.8 | 4 | 69 | 0 | 69 |
| Comp. Ex. 1 | Kerosene | 444.4 | 3.1 | 10.0 | 5 | 163 | 0 | 164 |
| Comp. Ex. 2 | Kerosene | 447.4 | 3.2 | 9.9 | 3 | 167 | 0 | 167 |
| Comp. Ex. 3 | Kerosene | 454.1 | 5.0 | 8.9 | 2 | 153 | 0 | 153 |
| Comp. Ex. 4 | Kerosene | 443.6 | 2.7 | 10.2 | 5 | 159 | 0 | 159 |
| Comp. Ex. 5 | Kerosene | 430.0 | 1.3 | 11.0 | 43 | 142 | 0 | 142 |
| Comp. Ex. 6 | Kerosene | 439.1 | 2.4 | 10.4 | 5 | 142 | 0 | 156 |

EXAMPLES 7 TO 11

7 g alkylnaphthalene sulfonate as an anionic surfactant, 1 l water, 2.2 g polyethylene oxide($OH(CH_2CH_2O)_nCH_2CH_2OH$,, n=500) and 0.8 g mathothyl were mixed and maintained at a temperature above 0° C. for 5 hours. Then, the 25 wt. % of resultant mixture was mixed with kerosene to prepare the emulsified fuel according to the present invention.

The emulsified fuel according to the present invention was combusted at a temperature as shown in Table 2. The components of the gas discharged during combustion were measured by BACHARACH MODEL CA300NSX. The concentrations of $O_2$, $CO_2$, excessive air, nitrogen oxides ($NO_x$) and CO were measured. The results are shown in Table 2.

EXAMPLES 12 TO 14

The 23 wt. % of mixture in accordance with the method in Examples 7 to 11 was mixed with gasoline to prepare the emulsified fuel. The resultant emulsified fuel was combusted at a temperature as shown in Table 2. The components of the gas discharged during combustion were measured by BACHARACH MODEL CA300NSX. The results are shown in Table 2.

COMPARATIVE EXAMPLES 7 to 12

The fuel, which contained gasoline alone, was combusted at a temperature as shown in Table 2. The components of the gas discharged during combustion were measured by BACHARACH MODEL CA300NSX. The results are shown in Table 2.

TABLE 2

| | Kind of fuels | Combustion Temp. (° C.) | $O_2$ (%) | Excess air (%) | $CO_2$ (%) | CO (ppm) | NOx (ppm) |
|---|---|---|---|---|---|---|---|
| Ex. 7 | Emulsified fuel | 492 | 2.7 | 13 | 13.6 | 16 | 56 |
| Ex. 8 | Emulsified fuel | 509 | 3.1 | 16 | 13.3 | 22 | 56 |
| Ex. 9 | Emulsified fuel | 499 | 2.1 | 10 | 14.0 | 18 | 54 |
| Ex. 10 | Emulsified fuel | 509 | 2.4 | 12 | 13.8 | 19 | 54 |
| Ex. 11 | Emulsified fuel | 511 | 2.6 | 13 | 13.7 | 19 | 53 |
| Ex. 12 | Emulsified fuel | 489 | 2.9 | 14 | 13.4 | 16 | 57 |
| Ex. 13 | Emulsified fuel | 498 | 3.3 | 17 | 13.1 | 14 | 57 |
| Ex. 14 | Emulsified fuel | 492 | 2.5 | 12 | 13.7 | 25 | 50 |
| Comp. Ex. 7 | Gasoline | 473 | 2.8 | 14 | 13.5 | 24 | 120 |
| Comp. Ex. 8 | Gasoline | 470 | 2.5 | 12 | 13.7 | 22 | 117 |
| Comp. Ex. 9 | Gasoline | 482 | 3.6 | 19 | 12.9 | 9 | 129 |
| Comp. Ex. 10 | Gasoline | 483 | 3.4 | 18 | 13.1 | 9 | 132 |
| Comp. Ex. 11 | Gasoline | 493 | 4.8 | 27 | 12.0 | 11 | 120 |
| Comp. Ex. 12 | Gasoline | 475 | 2.7 | 13 | 13.6 | 16 | 126 |

As shown in Tables 1 and 2, the amount of nitrogen oxides (NOx) discharged during combustion was dramatically reduced by using the emulsified fuel(Examples 1 to 14), compared to the use of kerosene or gasoline(Comparative Example 1 to 12). However, there was little difference in amount of CO discharged in the two cases

EXPERIMENT 1

The caloric value was analyzed to compare the efficiency of combusting the emulsified fuel according to Example 1 with that of combusting kerosene or gasoline alone (Comparative Example 1). The caloric value was calculated from the amount of water supplied by balancing the amount of water supplied to the boiler and the amount of generated vapor. The results are shown in Table 3.

EXAMPLES 2

As in Experiment 1, the caloric value was analyzed in the combustion of the emulsified fuel according to Example 12 and gasoline alone(Comparative Example 7). The results are shown in Table 3.

TABLE 3

| | Ex. 1 | Comp. Ex. 1 | Ex. 12 | Comp. Ex. 7 |
|---|---|---|---|---|
| Amount of fuel supplied (l/H) | 35 | 25 | 40. | 27.3 |
| Amount of water supplied (amount of vaporized) (l/H) | 195 | 166 | 270 | 225 |
| Amount of water vaporized by 1 l fuel (l) | 7.23 (5.57) | 6.64 | 8.77 (6.75) | 8.24 |

* The values in the parentheses of Examples 1 and 12 refer to the amount of water vaporized exclusive of the amount of water contained in the emulsified fuel. However, since 23 wt. % of water was contained in the emulsified fuel according to Examples 1 and 12, the amount of water vaporized was calculated by conversion of the amount into the same amount of kerosene.

As shown in Table 3, when Example 1 and Comparative Example 1 were compared using the same amount of kerosene, approximately 0.58 l more water evaporates in Example 1 than in Comparative Example 1. Therefore, it could be seen that the caloric value was higher in Example 1.

In the same way, when Example 12 and Comparative Example 7 were compared using the same amount of gasoline, approximately 0.75 l more water evaporates in Example 12 than in Comparative Example 7. Therefore, it could be seen that the caloric value was higher in Example 12.

As a result, the emulsified fuel according to the present invention exhibits high combustion efficiency, which can save kerosene and gasoline.

EXAMPLE 15

The amount of vapor generated(caloric value) and the components of the gas discharged were analyzed to compare the combustion efficiency of the emulsified fuel with that of conventional bunker oil.

In this case, the 20 wt. % of mixture according to Example 1 was mixed with bunker oil to prepare the emulsified fuel.

The components of the gas discharged were measured by BACHARACH MODE CA300NSX and the caloric value was calculated from the amount of water supplied by balancing the amount of water supplied to the boiler to the amount of vapor generated by loss of heat.

Vapor pressure was equalized to atmospheric conditions and water supplied to the boiler was controlled by a water-supply valve to maintain a constant water level by maintaining equal amounts of vapor generated and water supplied.

The amount of fuel supplied for combustion was calculated from the total weight of 1 lot(8 to 24 hr) fuel and the total time for combustion.

The amount of fuel used was assured by checking the amount supplied per time unit by installing a fuel tank with a scale, which supplied fuel to a pump.

However, attention was paid to the conditions such as the warming process to prevent freezing during winter and to employ a corrosion-proof pump because the emulsified fuel contained water. Results are given in Tables 4 and 5.

EXAMPLE 16

The procedure of Example 15 was followed, except that gasoline was used instead of bunker oil. Results are given in Tables 4 and 5.

EXAMPLE 17

The procedure of Example 15 was followed, except that kerosene was used instead of bunker oil. Results are given in Tables 4 and 5.

TABLE 4

| | | Analysis of gas discharged | | | | | | | | |
|---|---|---|---|---|---|---|---|---|---|---|
| | The allowable | Example 15 | | | Example 16 | | | Example 17 | | |
| Analyzed | Standard | | | R[3] | | | R[3] | | | R[3] |
| Item | of discharge | B[1] | E[2] | (%) | G[4] | E[2] | (%) | K[5] | E[2] | (%) |
| Smoke | — | 1 | 1 | — | 1 | 1 | — | 1 | 1 | — |
| CO | 350 ppm | 110.0 | 57.3 | 47.9 | 34.2 | 16.5 | 51.7 | 25.6 | 19.1 | 25.3 |
| Dust | 40–150 mg/Sm$^3$ | 154.3 | 66.5 | 56.9 | 89.2 | 6.5 | 92.7 | 5.2 | 1.6 | 69.2 |
| $So_x$ | Below 0.3% 180 ppm | 124.1 | 99.6 | 19.7 | 7.4 | 6.1 | 17 | 4.6 | 3.0 | 34.7 |
| $No_x$ | below 250 ppm | 201.1 | 173 | 14 | 88.5 | 57.8 | 34.6 | 81.8 | 36.3 | 55.6 |

[1]Bunker oil,
[2]Emulsified fuel,
[3]Percentage of reduction
[4]Gasoline,
[5]Kerosene

TABLE 5

| | Analysis of caloric value versus fuel reduction | | | | | |
|---|---|---|---|---|---|---|
| | Example 15 | | Example 16 | | Example 17 | |
| | B[1] | E[2] | Gasoline | E[2] | Kerosene | E[2] |
| Input fuel value (kg/30 min.) | 13.58 | 14.69 | 13.02 | 14.01 | 10.00 | 12.76 |
| Value of water supplied (kg/30 min.) | 105.20 | 111.79 | 109.44 | 108.86 | 100.25 | 114.98 |
| Net input fuel value[3] (kg/30 min.) | | 11.99 | | 11.11 | | 9.96 |
| Evaporative value of vapor(kg/30 min.) | 7.74 | 9.32 | 8.41 | 9.76 | 10.02 | 11.54 |
| Percentage of Fuel reduction | | 20.41% | | 16.4% | | 15.16% |

[1]Bunker oil
[2]Emulsified fuel
[3]the amount of pure fuel exclusive of the amount of water present in the fuel As described in Table 4, the rate of CO, dust, $NO_X$ and $SO_X$ generated was considerably reduced in the said emulsified fuel using bunker oil, gasoline and kerosene as the crude oil in accordance with this invention, compared to the case where bunker oil, gasoline or kerosene was used independently.

Therefore as shown in Table 5, compared to the respective use of bunker oil, gasoline, or kerosene, the emulsified fuel according to this invention raised the caloric value thereby saving fuel.

THE EFFECT OF THE INVENTION

It has been found that the emulsified fuel of the claimed invention has many advantages, that it can reduce pollutants, a major cause of air pollution, in particular nitrogen oxides and also limit the generation of ash, smoke and soot because the above-mentioned emulsified fuel can burn out completely.

As a result of such restriction, the amount of soot attached on the surface of electric heat in the combustion chamber is reduced, which raises the heat delivering effect on the surface of electric heat, lowers the temperature of combusted gas discharged and increases the efficiency of the boiler. Furthermore, it may also be effective in terms of energy saving due to the high combustion efficiency. The emulsified fuel according to the present invention may be conveniently used in small, middle or large boilers without special equipment to control the mixing ratio of fuel oil to water which is required for optimization of fuel.

What is claimed is:

1. An emulsified fuel prepared by mixing the fuel with 10 to 50 wt. % of a water mixture of 0.01 to 1.0 parts by weight of an anionic surfactant, 0.01 to 0.5 parts by weight of polyethylene oxide and 0.001 to 0.2 parts by weight of mathothyl per 100 parts by weight of water.

2. The emulsified fuel of claim 1, wherein the anionic surfactant is selected from the group consisting of an alkyl naphthalene sulfonate, a di-alkyl sulfosuccinate, an alkylbenzene sulfonate, an alkylsulfoacetate, an α-olefin sulfonate, a sodium N-acylmethyl taurate, an alkylether phosphate, an alkyl phosphate, an acyl peptide, an alkylether carboxylate, an N-acyl-aminoaxid, a fatty alcohol sulfate, an alkylether sulfate, a polyoxyethylene alkylphenyl ether sulfate and mixtures thereof and the polyethylene oxide has the general formula $OH(CH_2CH_2O)_nCH_2CH_2OH$, wherein n is an integer having a value of greater than 300 and up to 800.

* * * * *